US007104433B2

(12) United States Patent
Fujiyama

(10) Patent No.: US 7,104,433 B2
(45) Date of Patent: Sep. 12, 2006

(54) SAFETY APPARATUS OF AIR IMPACT DRIVER

(75) Inventor: Takeo Fujiyama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 1 day.

(21) Appl. No.: 10/498,873

(22) PCT Filed: Aug. 7, 2002

(86) PCT No.: PCT/JP02/08074

§ 371 (c)(1),
(2), (4) Date: Nov. 19, 2004

(87) PCT Pub. No.: WO03/013796

PCT Pub. Date: Feb. 20, 2003

(65) Prior Publication Data

US 2005/0115725 A1 Jun. 2, 2005

(30) Foreign Application Priority Data

Aug. 8, 2001 (JP) ..... 2001-241323
Aug. 8, 2001 (JP) ..... 2001-241331

(51) Int. Cl.
*B25B 17/00* (2006.01)
*B25B 23/04* (2006.01)

(52) U.S. Cl. ..... 228/8; 227/130; 81/434; 81/57.44; 173/11; 173/93.5

(58) Field of Classification Search ..... 173/4, 173/11, 93, 93.5; 227/8, 130; 81/57.13, 81/434, 467, 57.44
See application file for complete search history.

(56) References Cited

U.S. PATENT DOCUMENTS

| | | | | |
|---|---|---|---|---|
| 3,895,562 | A * | 7/1975 | El Guindy | 91/308 |
| 5,862,724 | A * | 1/1999 | Arata et al. | 81/434 |
| 5,921,156 | A * | 7/1999 | Takezaki et al. | 81/57.13 |
| 6,205,894 | B1 * | 3/2001 | Tanaka | 81/470 |
| 6,247,387 | B1 * | 6/2001 | Ketteringham | 81/467 |
| 6,672,404 | B1 * | 1/2004 | Kamo et al. | 173/11 |
| 6,843,400 | B1 * | 1/2005 | Lee | 227/8 |

FOREIGN PATENT DOCUMENTS

| | | |
|---|---|---|
| EP | 774325 A2 | 5/1997 |
| JP | 42-1157 B1 | 1/1967 |
| JP | 53-33478 A | 3/1978 |

* cited by examiner

*Primary Examiner*—Scott A. Smith
(74) *Attorney, Agent, or Firm*—Morgan, Lewis & Bockius LLP

(57) ABSTRACT

A nose (5) of an air impact driver (1) is mounted with a slidable contact nose (12) and by the contact nose, a contact valve (23) upward therefrom is operated to switch. An AND circuit operated to pilot an air motor controlling pilot valve (39) and a piston controlling pilot valve (41) is constituted by a trigger valve (8) operated by a trigger lever (9) and the contact valve (23). When the contact nose is pressed and the trigger lever is pulled, the air motor controlling pilot valve and the piston controlling pilot valve are switched to starting positions to start the air impact driver.

3 Claims, 14 Drawing Sheets

SAFETY APPARATUS OF AIR IMPACT DRIVER

TECHNICAL FIELD

The present invention relates to a safety apparatus for preventing an air impact driver from being started by erroneous operation, particularly relates to a safety apparatus of an air impact driver constituted by a pneumatic circuit.

BACKGROUND ART

An air impact driver provided for screwing a building material of a plaster board or the like is mounted with a mechanical type safety apparatus by a contact arm similar to a nail striker. The contact arm is an arm formed in a crank-like shape along outer shapes of a nose and a cylinder housing of the air impact driver which is slidable in parallel with the nose, a front end thereof is projected frontward from the nose and other end reaches a front face of a trigger lever of a main body of the air impact driver.

A trigger lever is attached with a pivotable free arm and when the contact arm is pressed to a side of the main body of the air impact driver, a front end portion of the free arm attached to the trigger lever is pressed by the contact arm to be proximate to a stem of a trigger valve. When the trigger lever is pulled under the state, the free arm is pivoted in a direction of the trigger valve by constituting a fulcrum by the front end portion along with the trigger lever and the stem of the trigger valve is pressed by the free arm to start the air impact driver. Further, even when first, the trigger lever is pulled and thereafter the contact arm is pressed to an object face of screwing, the free arm presses the stem of the trigger arm to start to the air impact driver similar to the above-described operation.

In this way, the trigger lever and the contact arm are constituted to cooperatively make the trigger valve ON, when only the trigger lever is operated, the free arm does not reach a position of the stem of the trigger arm and the air impact driver cannot be started to thereby prevent the air impact driver from being started by erroneously operating the trigger lever.

According to the mechanical type safety mechanism of the above conventional art, the contact arm passes a side face of the cylinder-housing and therefore, a width of a total of the air impact driver is widened and there is a case in which it is difficult to strike a screw to a corner portion or a location having a narrow width. Further, according to the constitution in which the front end of the free arm attached to the trigger lever is pressed up by sliding the contact arm and the total of the free arm is moved by pulling the trigger lever to thereby press the stem of the trigger valve, there poses a problem that the stroke of pressing the contact arm is prolonged and therefore, operability is not excellent, further, operation of one cycle is devoid of swiftness.

Further, as other problem, there is a case in which the contact arm cannot be slid by clogging a plaster powder produced in screwing between a slide guide supporting the long contact arm and the contact arm and when the contact arm is not returned from a pressing position to an initial position, there poses a problem that when the trigger lever is erroneously operated, the air impact driver is started and the safety mechanism does not function.

DISCLOSURE OF THE INVENTION

A technical problem to be resolved is posed for providing an air impact driver improving difficulty in fastening screw to a corner portion or a narrow portion and general operability owing to the above-described problem and it is an object of the invention to resolve the above-described problem.

The invention is proposed in order to achieve the above-described object to provide a safety apparatus of an air impact driver mounting a slidable contact nose to a nose of the air impact driver, providing a contact valve operated to switch by moving to slide the contact nose, constituting an air pressure logic circuit for controlling a starting control valve of the air impact driver by a trigger valve operated by a trigger lever and the contact valve and providing a pneumatic signal to start the air impact driver when the trigger lever and the contact valve are switched to ON positions by pulling the trigger lever.

Further, the invention provides a safety apparatus of an air impact driver mounting a slidable contact nose to a nose of the air impact driver, connecting a contact valve to the contact nose, providing an air pressure logic circuit for controlling a starting control valve of the air impact driver by a trigger valve operated by a trigger lever and the contact valve, providing a pneumatic signal to start the air impact driver when the contact nose is pressed and the trigger valve and the contact valve are switched to ON positions by pulling the trigger lever, wherein the contact valve is a switch valve communicating a secondary side outlet to a primary side inlet at an ON position and communicating the secondary side outlet to an atmosphere at an OFF position.

BRIEF DESCRIPTION OF THE DRAWINGS

FIG. 2 is a sectional view of a state of operating a contact nose of the air impact driver ON.

FIG. 3 is a sectional view of a state of operating the contact nose and a trigger lever of the air impact driver ON.

FIG. 7 is a sectional view of a state of making the contact valve ON.

FIG. 9 is a sectional view showing a state of making the contact valve of FIG. 8 ON.

FIG. 12 is a sectional view showing a state of making the contact valve of FIG. 11 ON.

FIG. 14 is a sectional view showing a state of making the contact valve of FIG. 13 ON.

Figure 1:
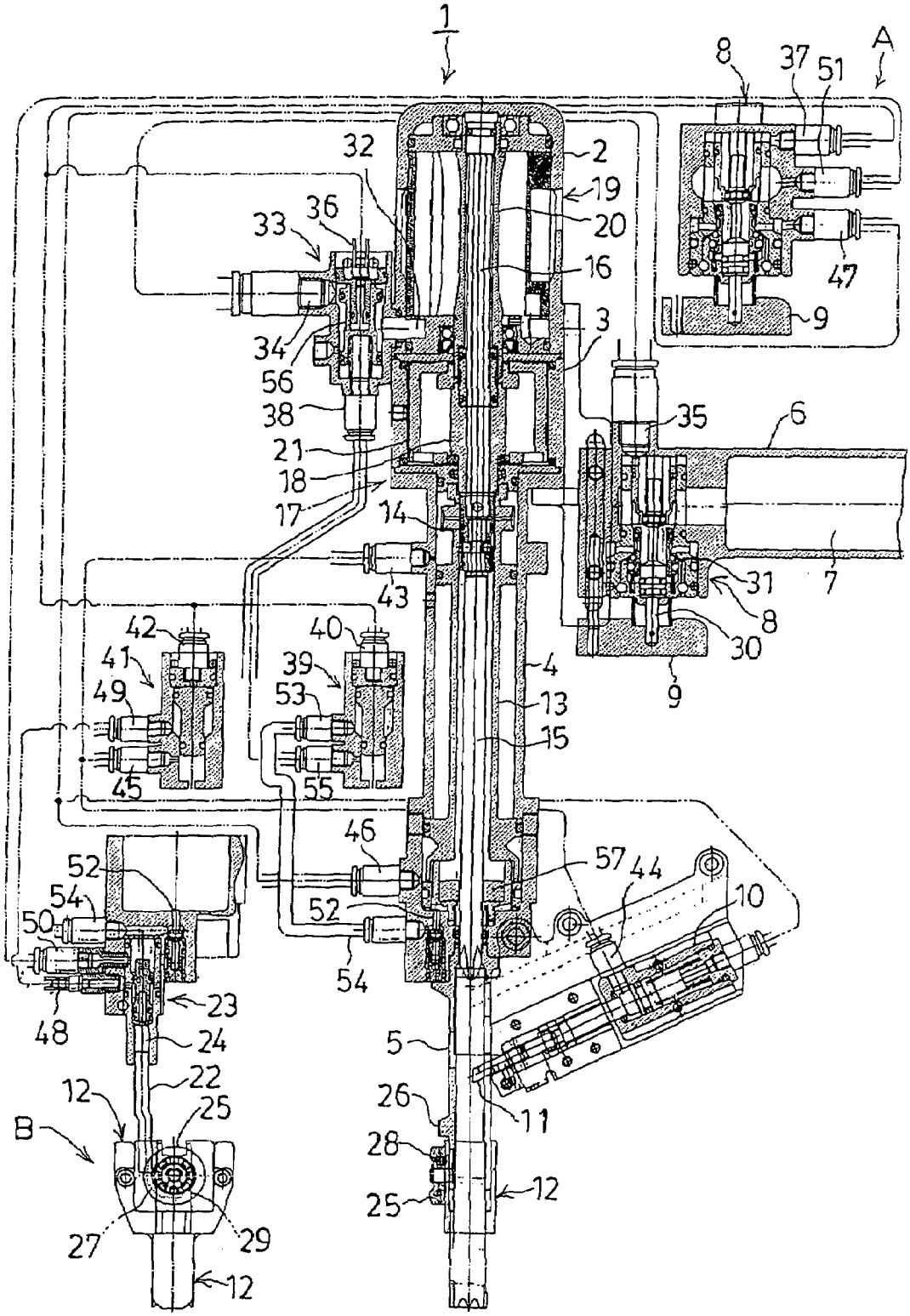
FIG. 1 is a sectional view showing a standby state of an air impact driver showing an embodiment of the invention.

Further, in notations in the drawings, numeral 1 designates an air impact driver, numeral 5 designates a nose, numeral 8 designates a trigger valve, numeral 9 designates a trigger lever, numeral 12 designates a contact nose, numeral 13 designates an air cylinder, numeral 14 designates a piston, numeral 15 designates a hexagonal shaft, numeral 17 designates an impact mechanism, numeral 19 designates an air motor, numeral 22 designates a rod, numeral 23 designates a contact valve, notation 23*a* designates a spool, numeral 33 designates an air motor switch valve, numeral 39 designates an air motor controlling pilot valve, numeral 41 designates a piston controlling pilot valve, numeral 52 designates a poppet valve, numeral 71 designates a contact valve, numeral 72 designates a cylinder portion, numeral 73 designates a spool, numeral 81 designates a contact valve, numeral 82 designates a cylinder portion, numeral 83 designates a vent hole and numeral 84 designates a spool.

BEST MODE FOR CARRYING OUT THE INVENTION

A detailed description will be given of an embodiment of the invention in reference to the drawings as follows. FIG. 1 through FIG. 4 show the air impact driver 1 which is constituted by a cabinet structure connected with an air motor housing 2, a clutch housing 3, a cylinder housing 4, and the nose 5 in one row from above and attached with a grip 6 extended from the clutch housing 3 in a direction orthogonal thereto. Similar to a general pneumatic tool, an air plug is attached to an end portion of the grip 6 although illustration thereof is omitted, an air hose is connected to the air plug and high pressure air is supplied from an air compressor to an air chamber 7 at inside of the grip 6. A base portion of the grip 6 is provided with the trigger valve 8 and the trigger lever 9 and the air impact driver 1 is started and stopped by opening and closing the trigger valve 8 by operating the trigger lever 9.

A back face (right side of drawing) of the nose 5 is provided with a known connecting screw feeding apparatus comprising a spring offset type air cylinder 10 and a feed claw 11 connected to a piston rod thereof and a connecting screw at inside of a connecting screw magazine (not illustrated) is fed into the nose 5 by moving the feeding claw 11 forward and rearward in cooperation with one cycle operation of the air impact driver 1. Further, a portion A on a right upper side of the drawing is the sectional view viewing a portion of the trigger valve 8 from a right side, a portion B on a left lower side thereof is a sectional view viewing a portion of the contact nose 12 from a left side and air pipes are indicated by chain lines.

The piston 14 of the air cylinder 13 included in the cylinder housing 4 is attached with the driver bit 15 at a front face (lower side of the drawing) thereof and attached with the hexagonal shaft 16 at a back face (upper side of the drawing) thereof. The impact mechanism 17 of a centrifugal meshing type is included in the clutch housing 3, a hexagonal hole is formed at a center of a driven rotating member 18 (hereinafter, referred to as anvil) having a horizontal section in a butterfly-like shape arranged at a center thereof and the hexagonal hole is penetrated by the hexagonal shaft 16. The rotor 20 of the air motor 19 arranged above the impact mechanism 17 is provided with a center hole having a diameter larger than that of the hexagonal shaft 16 and an upper portion of the hexagonal shaft 16 advances into the center hole. The piston 14 and the driver bit 15 and the hexagonal shaft 16 are rotated around an axis along with the anvil 18 of the impact mechanism 17 and made to be liftable at inside of the air cylinder 13.

Figure 5:
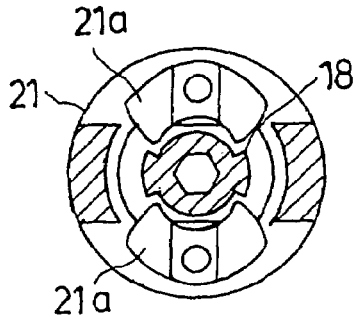
FIG. 5(*a*) through FIG. 5(*e*) are sectional views showing steps of operating an impact mechanism.
Figure 5:
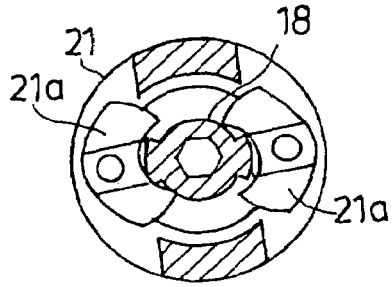
Figure 5:
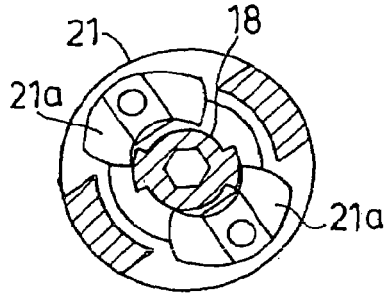
Figure 5:
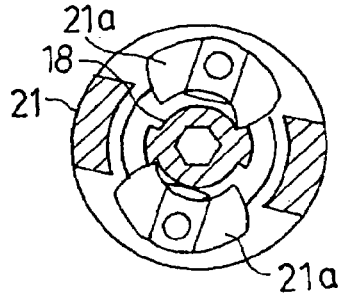
Figure 5:
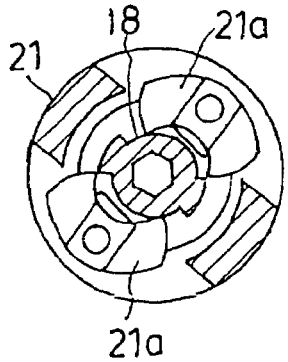

Impact operation by the air motor 19 and the impact mechanism 17 is well known and the rotor 20 of the air motor 19 is coupled to an outer rotor 21 of the impact mechanism 17 and the both members are integrally rotated. As shown by FIG. 5(*a*), the outer rotor 21 is pivotably attached with a hammer 21*a* of a lever type. When the outer rotor 21 is started to rotate in the clockwise direction of the drawing, a rear side in a rotational direction of the hammer 21*a* is pivoted in a rotational center direction by static inertia and a corner portion of the rear side is brought into contact with the anvil 18 as shown by FIG. 5(*b*) and rides over a projected portion of the anvil 18 to be pushed out to an outer side reverse to the side in starting as shown by FIG. 5(*c*). Thereby, as shown by FIG. 5(*d*), a corner portion on a front side in the rotational direction thereof is pivoted in the rotational center direction to be brought in mesh with the projected portion of the anvil 18 to rotate while impacting the anvil 18. Further, by rotating the anvil 18, as shown by FIG. 5(*e*), the corner portion of the front side of the hammer 21*a* is detached from the anvil 18 and as shown by FIG. 5(*b*), the corner portion on the rear side is brought into contact with the anvil 18. In the following, the hammer 21*a* is circulated at high speed in a swinging cycle of FIG. 5(*b*) through FIG. 5(*e*) to continuously strike the anvil 18 in the rotational direction to thereby rotate the hexagonal shaft 16 and the piston 14 and the driver bit 15.

Next, the contact nose 12 of FIG. 1 will be explained. The contact nose 12 fitted to an outer peripheral face of a front end portion of the nose 5 can be slid upwardly relative to the nose 5. The contact nose 12 is attached with the rod 22 to direct to an upper side thereof and a front end of the rod 22 is brought into a rod guide hole of the contact valve 23 provided at a lower portion of the cylinder housing 4 to be brought into contact with a stem 24 at inside of the rod guide hole.

A stroke adjusting dial 25 is attached to a center of a front face of the contact nose 12 and a stopper 26 formed at the nose 5 is disposed upward from the stroke adjusting dial 25. A rear face of the stroke adjusting dial 25 is formed with a cam portion 27 a radius from a rotational center of which is changed in steps (8 steps in the illustrated example) by a rotational angle thereof. A clip stop mechanism of 8 steps is formed by springs (not illustrated) and balls 28 inserted into holes at a rear face of the stroke adjusting dial 25 and ball receiving holes 29 aligned in a ring-like shape at a front face of the contact nose 12 to thereby fix the stroke adjusting dial 25 at every constant rotational angle.

The stopper 26 provided at the nose 5 is opposed to an outer peripheral face of the cam portion 27 of the stroke adjusting dial 25 and when the contact nose 12 is slid to an upper side, the outer peripheral face of the cam portion 27 is brought into contact with the stopper 26 to stop the contact nose 12. As described above, the radius of the cam portion 27 brought into contact with the stopper 26 differs by the rotational angle of the stroke adjusting dial 25 and therefore, a stroke of sliding the contact nose 12 to the upper side can be adjusted in 8 steps by rotating the stroke adjusting dial 25 to arbitrary click positions, thereby, a depth of fastening the screw can be adjusted.

Successively, an explanation will be given of a pneumatic circuit and an operational stroke of the air impact driver 1. FIG. 1 shows a standby state, a stem 30 of the trigger valve 8 is moved down to a closed position and a puppet 31 coaxial with the stem 30 is moved up by a spring and a pneumatic pressure operated to a lower face thereof.

An intake port 32 of the air motor 19 is connected with the air motor switching valve 33, an input port 34 of the air motor switching valve 33 is connected to an upper output port 35 of the trigger valve 8, an upper pilot port 36 is connected to an upper output port 37 of the trigger valve 8 shown in the portion A, and a lower pilot port 38 is connected to the air motor controlling pilot valve 39.

An upper pilot port 40 of the air motor controlling pilot valve 39 and an upper pilot port 42 of the piston controlling pilot valve 41 on the left are connected to the upper output port 37 of the trigger valve 8 shown in the portion A.

An upper port 43 of the air cylinder 13 and a front port 44 of the spring offset type air cylinder 10 of the connecting screw feeding apparatus are connected to the lower port 45 of the piston controlling pilot valve 41 and a lower port 46 of the air cylinder 13 is connected to a lower port 47 of the trigger valve 8 shown in the portion A.

A lower port 48 of the contact valve 23 arranged at a lower portion of the cylinder housing 4 is connected to an upper port 49 of the piston controlling pilot valve 41 and an upper port 50 of the contact valve 23 is connected to an air chamber connecting port 51 shown in the portion A.

The lower port 48 of the contact valve 23 and the small-sized poppet valve 52 arranged to be contiguous to the contact valve 23 are communicated via a clearance at an outer periphery of the contact valve 23 and the poppet valve 52 opens and closes a path 54 communicating with an upper port 53 of the motor controlling pilot valve 39.

Figure 6:
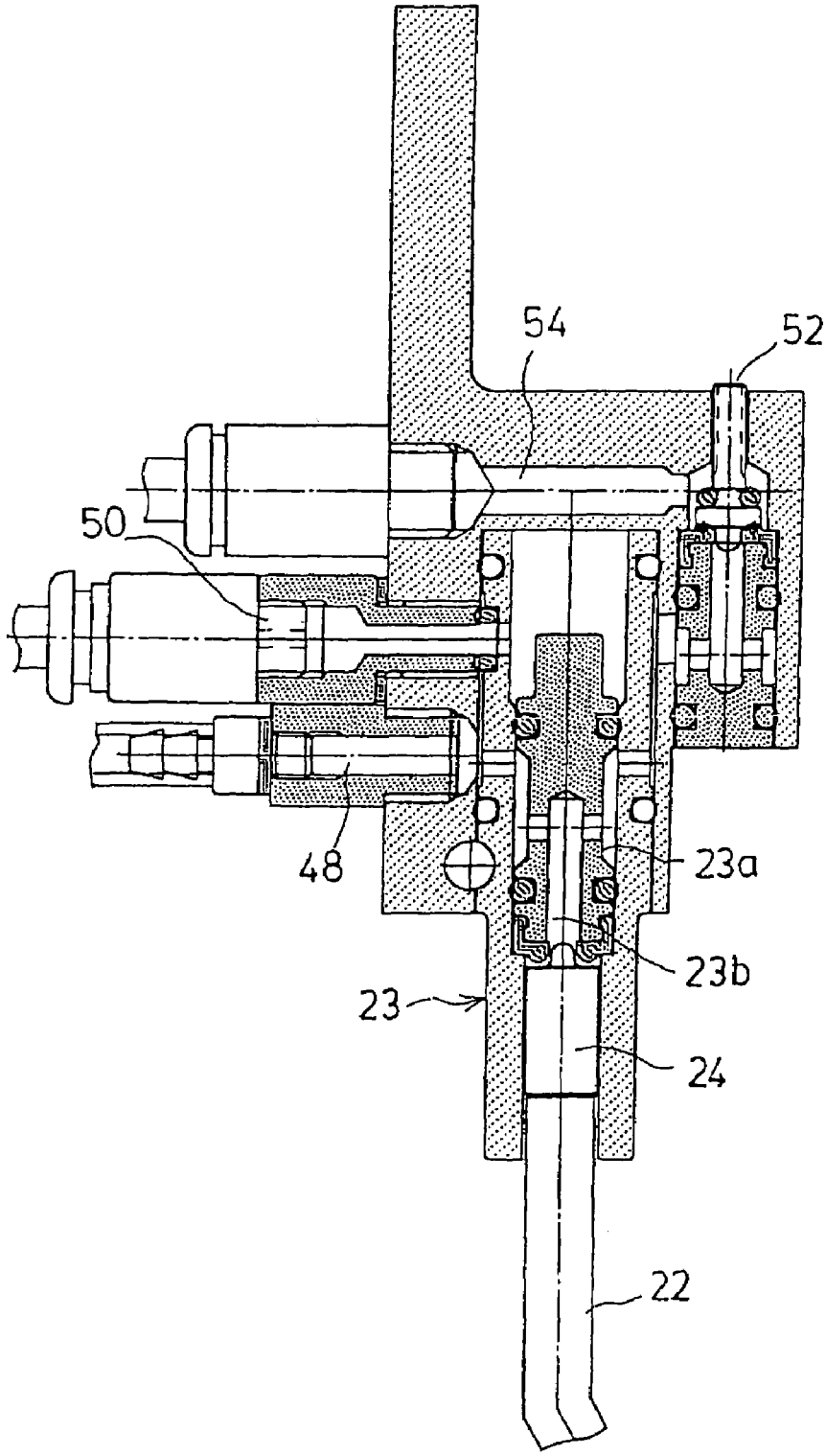
FIG. 6 is a sectional view of an initial state of a contact valve.

In further details, as shown by FIG. 6, the small-sized poppet valve 52 arranged to be contiguous to the contact valve 23 and the lower port 48 of the contact valve 23 are communicated via the clearance at the outer periphery of the contact valve 23 and the poppet valve 52 opens and closes the path 54 to the upper port 53 of the air motor controlling pilot valve 39. The spool 23*a* of the contact valve 23 is formed with an exhausting path 23*b* communicating an outer peripheral face of a middle portion thereof to a bottom face thereof on a side of the stem 24 and at an initial position shown in FIG. 6, the lower port 48 constituting a secondary side path is communicated with the atmosphere via the exhausting path 23*b*of the spool 23*a*.

As shown by FIG. 1 and FIG. 6, in the initial state (state at a standby position) in which the trigger valve 8 is disposed at a closed position and the contact noses 12 is moved down, high pressure air in the air chamber 7 is supplied from the lower port 47 of the trigger valve 8 to a lower air chamber via the lower port 46 of the air cylinder 13 to push up the piston 14 to an upper standby position.

Figure 2:
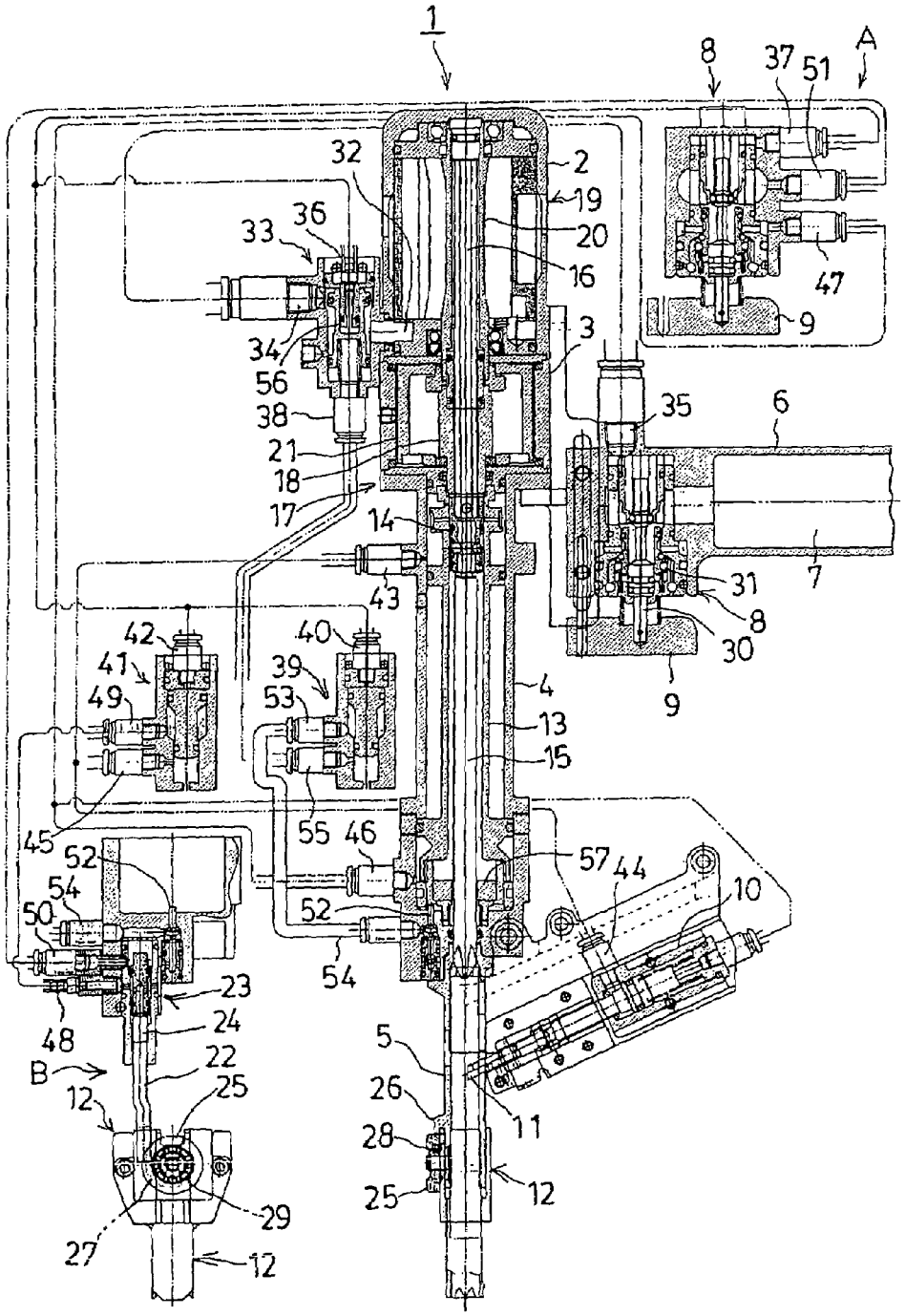
Figure 7:
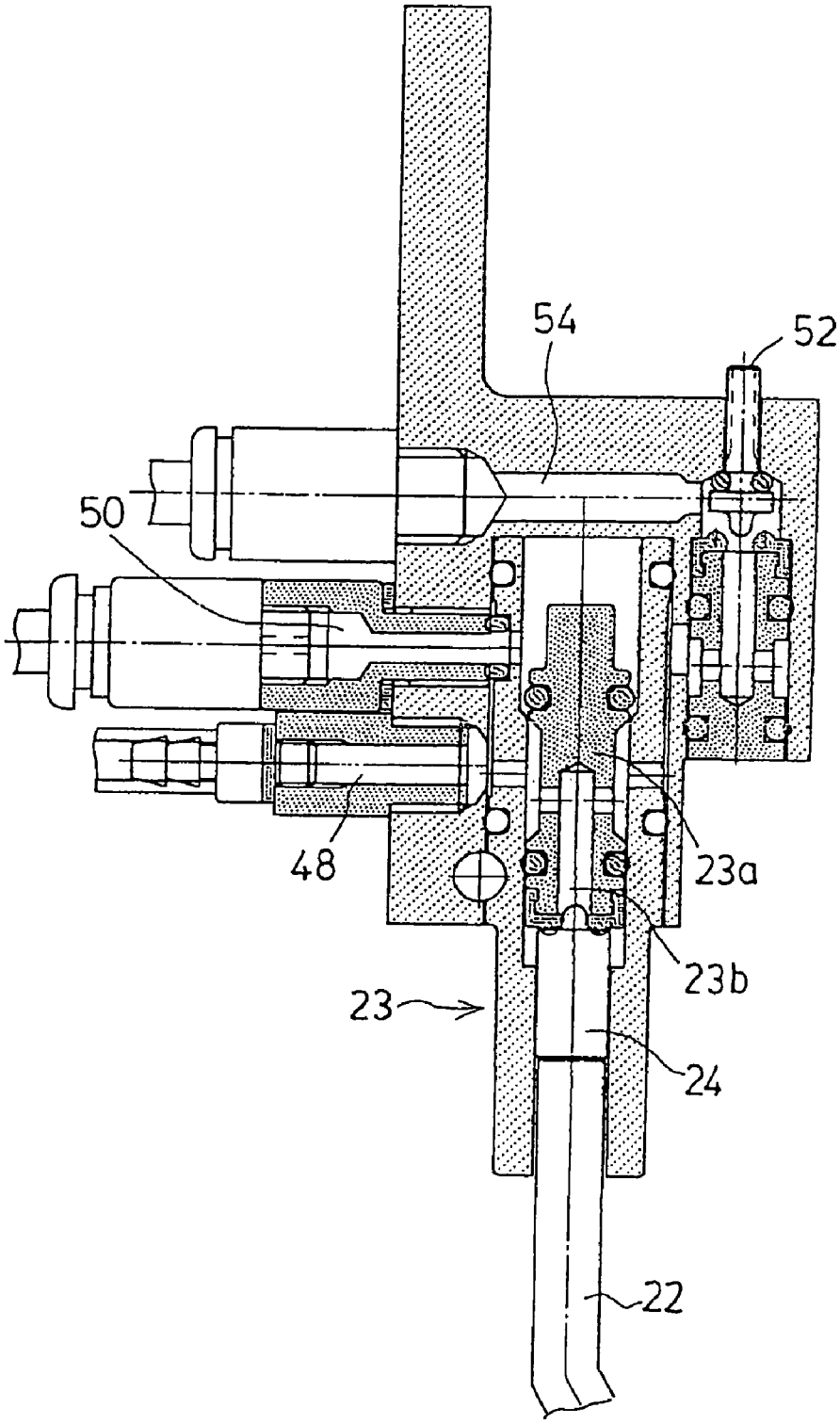

FIG. 2 and FIG. 7 show a state of bringing the contact nose 12 into contact with an object face of screwing to press, the spool 23*a* of the contact valve 23 is pushed up by the rod 22 of the contact nose 22 to communicate the upper port 50 and the lower port 48, pressurized air is supplied to an air chamber of the piston controlling pilot valve 42 via the lower port 48, as shown by FIG. 2, a spool of the piston controlling pilot valve 41 is moved up to cut the upper port 49 and the lower port 45. Further, simultaneously therewith, pressurized air pushes up the poppet valve 52 via the path of the outer periphery of the contact valve 23, pressurized air is supplied to an air chamber of the air motor controlling pilot valve 39 via the output path 54, and a spool is moved up to maintain a state of cutting the upper port 53 and the lower port 55.

Figure 3:
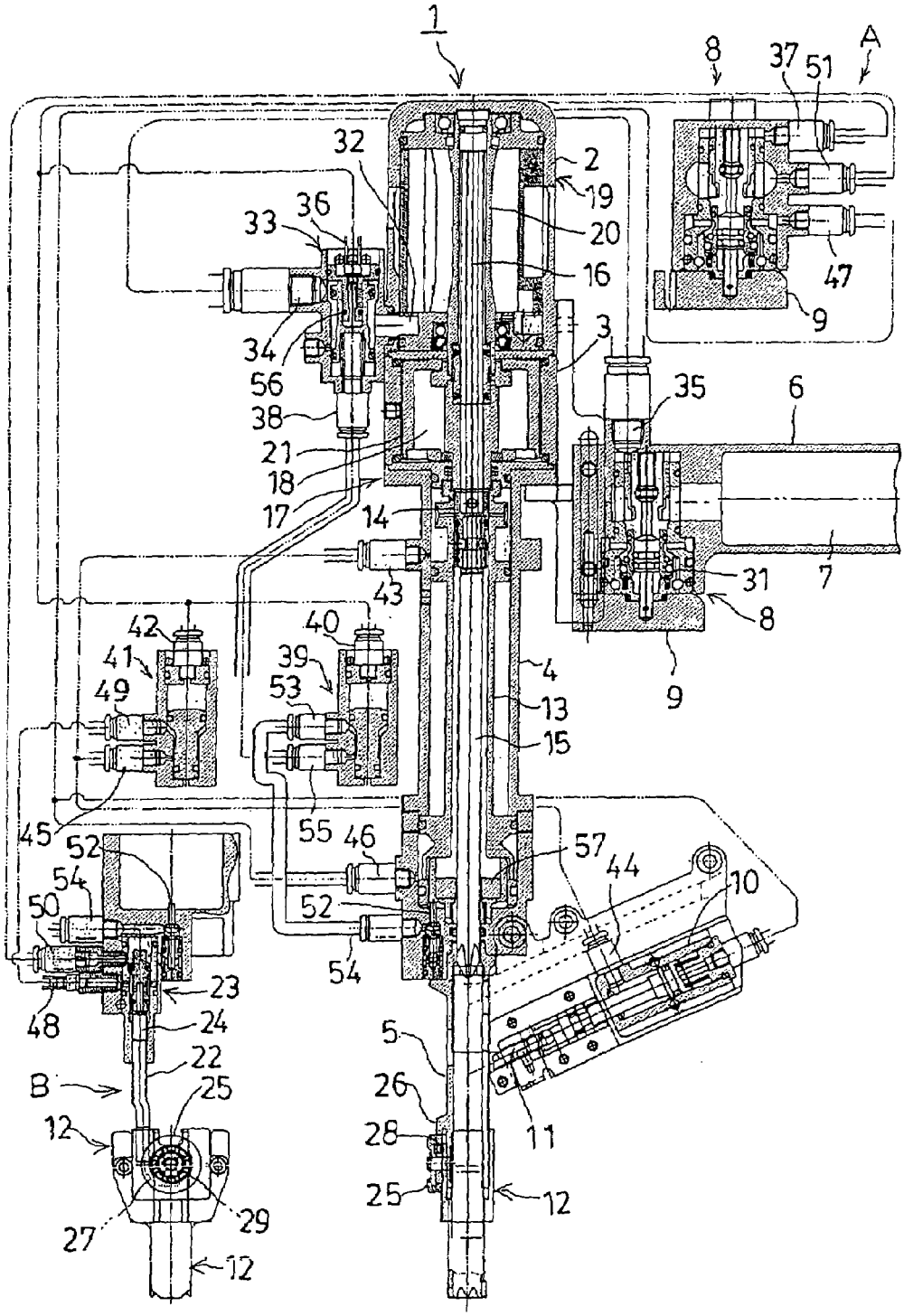

Successively, when the trigger lever 9 is pulled as shown by FIG. 3, the stem 30 of the trigger valve 8 is moved up to communicate the upper ports 35, 37 of the trigger valve 8, pressurized air operated to a lower face of the poppet 31 is exhausted from a surrounding of the stem 30 to a lower side to move down the poppet 31 and air at the lower air chamber of the air cylinder 13 is exhausted to the atmosphere via the trigger valve 8.

Further, pressurized air is supplied to the input port 34 of the air motor switching valve 33 via the upper port 35 of the trigger valve 8, and a pilot pressure is applied to the upper pilot port 36 of the air motor switching valve 33, the pilot port 40 of the air motor controlling pilot valve 39 and the pilot port 42 of the piston controlling pilot valve 41. Thereby, the spool of the air motor switching valve 33, the spool of the air motor controlling pilot valve 39 and the spool of the piston controlling pilot valve 41 are moved down, pressurized air is supplied from the lower port 48 of the contact valve 23 disposed at the lower portion of the cylinder housing 4 to an upper air chamber of the air cylinder 13 via the piston controlling pilot valve 41, and the piston 14 and the driver bit 15 and the hexagonal shaft 16 start moving down.

Further, pressurized air is supplied to the lower pilot port 38 of the air motor switching valve 33 via the lower port 55 of the air motor controlling pilot valve 39, the spool 56 of the air motor switching valve 33 is moved up and after moving down the piston 14, the air motor 19 is started and the piston 14 and the driver bit and the hexagonal shaft 16 start rotating, when the air motor 19 is started, the anvil 18 and the hexagonal shaft 16, the piston 14, the driver bit 15 are rotated by high speed impact operation of the impact mechanism 17 and the screw is fastened to the object of screwing.

Figure 4:
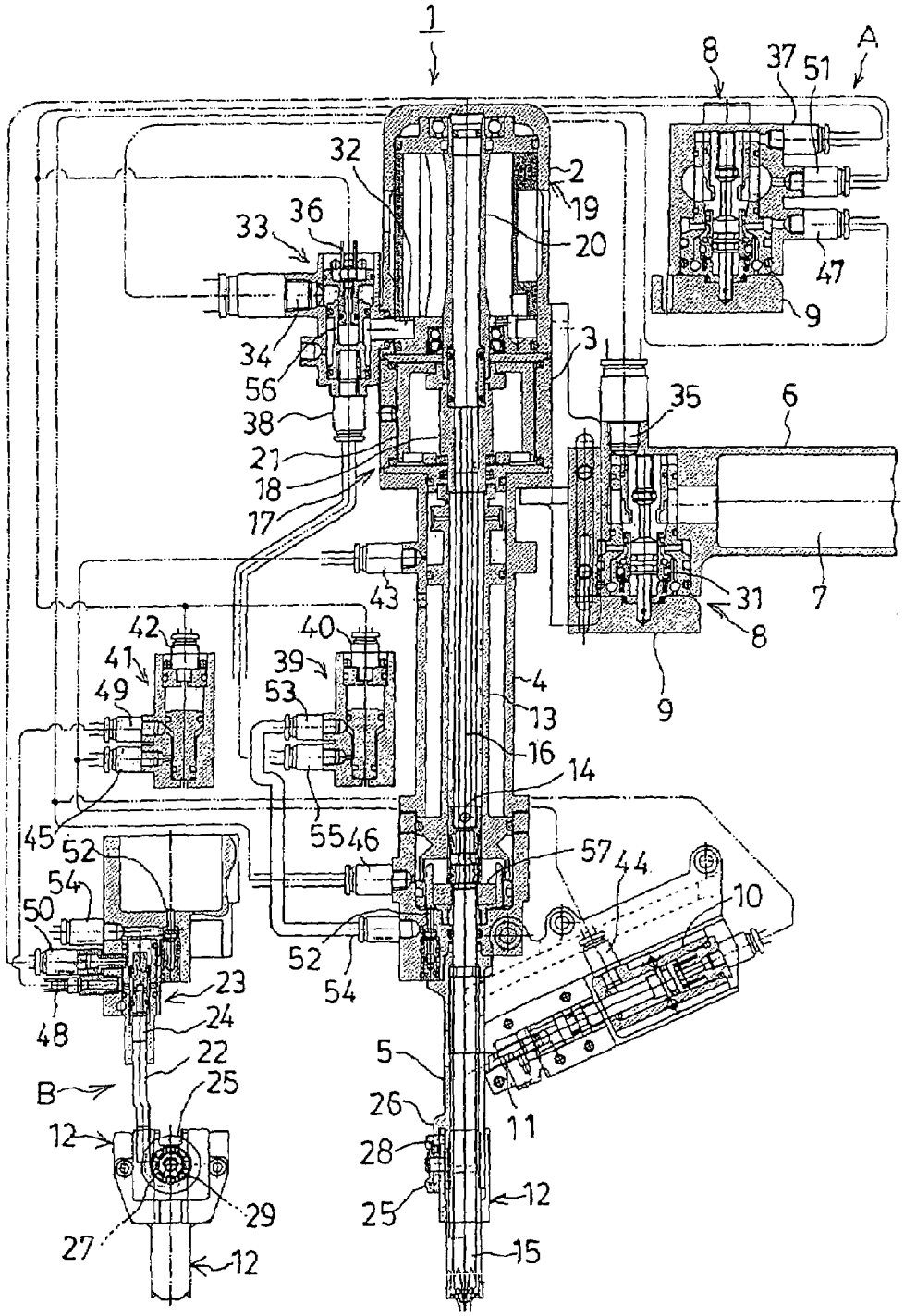
FIG. 4 is a sectional view showing a state of finishing to fasten a screw by the air impact driver.

FIG. 4 shows a state of finishing to screw and the piston 14 reaches a lower end of a movable range to push down a bumper 57 at inside of the air cylinder 13 and the poppet valve 52 at a bottom portion thereof. By moving down the poppet valve 52, pressurized air supplied to the lower air chamber of the air motor switching valve 33 via the air motor controlling pilot valve 39 is exhausted from the trigger valve 8 via the poppet 52 and the lower port 46 of the air cylinder. Thereby, the air pressure operated to the lower face of the spool 56 of the air motor switching valve 33 is reduced to move down the spool 56 and the input port 32 of the air motor 19 and the air chamber 7 are cut to stop rotating the air motor 19.

When the trigger lever 9 is released after finishing to fasten to screw, the stem 30 of the trigger valve 8 is moved down to the initial position, pressurized air is brought into the lower face of the poppet 31 to move up the poppet 31, pressurized air is supplied from the air chamber 7 to the lower air chamber of the air cylinder 13 via the lower port 47 of the trigger valve 8 and the piston 14 is moved up to return to the initial position.

Next, an explanation will be given of a case of operating to switch on only the trigger lever 9 in the initial state shown in FIG. 1. When the trigger valve 8 is switched on by operating the trigger lever 9, the pilot pressure is applied to the respective upper pilot ports 36, 40, 42 of the air motor switching valve 33 and the air motor controlling pilot valve 39 and the piston controlling pilot valve 41 and the respective spools of the air motor controlling pilot valve 39 and the piston controlling pilot valve 41 are moved down to open positions.

At this occasion, since the contact valve 23 operated by the contact nose 12 stays to be in the initial state, pressurized air is not supplied to the motor controlling pilot valve 30 and the piston controlling pilot valve 41 and the air motor 19 (and the air cylinder 13) stay to be in a stationary state. Further, pressurized air is not supplied from the air motor controlling pilot valve 39 to the lower pilot port 38 of the air motor switching valve 33 in cooperation with operation of the piston controlling pilot valve 41 and therefore, the spool 56 of the air motor switching valve 33 is moved down by the pilot pressure applied to the upper pilot port 36 to cut the input port 32 of the air motor 19 and the air chamber 17 and therefore, the air motor 19 is not started and the air impact driver can be prevented from being started by erroneously operating the trigger lever similar to the mechanical type safety apparatus of the prior art.

Successively, an explanation will be given of the safety measure when the contact nose 12 is temporarily pushed and thereafter returned to the initial position. When pressing is released from the state of pressing the contact nose shown in FIG. 7, and the spool 23*a* of the contact valve 23 returns to the initial state shown in FIG. 6, pressurized air supplied to the air chamber of the piston controlling pilot valve 41 and the air chamber of the air motor controlling pilot valve 39 is exhausted to the atmosphere via the exhaust path 23*b* of the spool 23*a* of the contact valve 23. Thereby, even when the trigger lever 9 is operated, similar to the above-described case of operating to switch ON only the trigger lever 9, the air cylinder 13 and the air motor 19 are not started.

Figure 8:
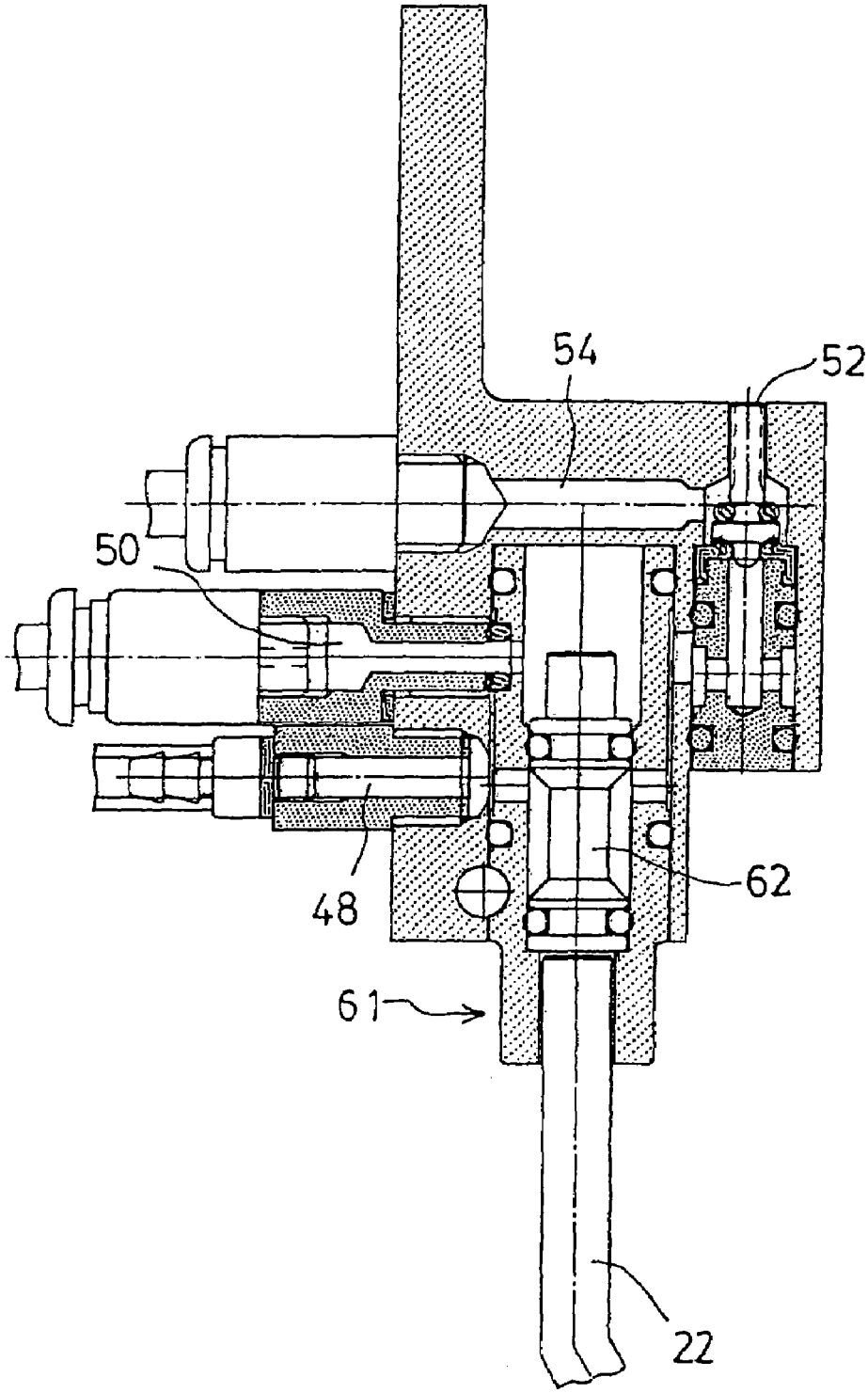
FIG. 8 is a sectional view showing an initial state of a contact valve which is not subjected to an erroneous starting preventing measure.
Figure 9:
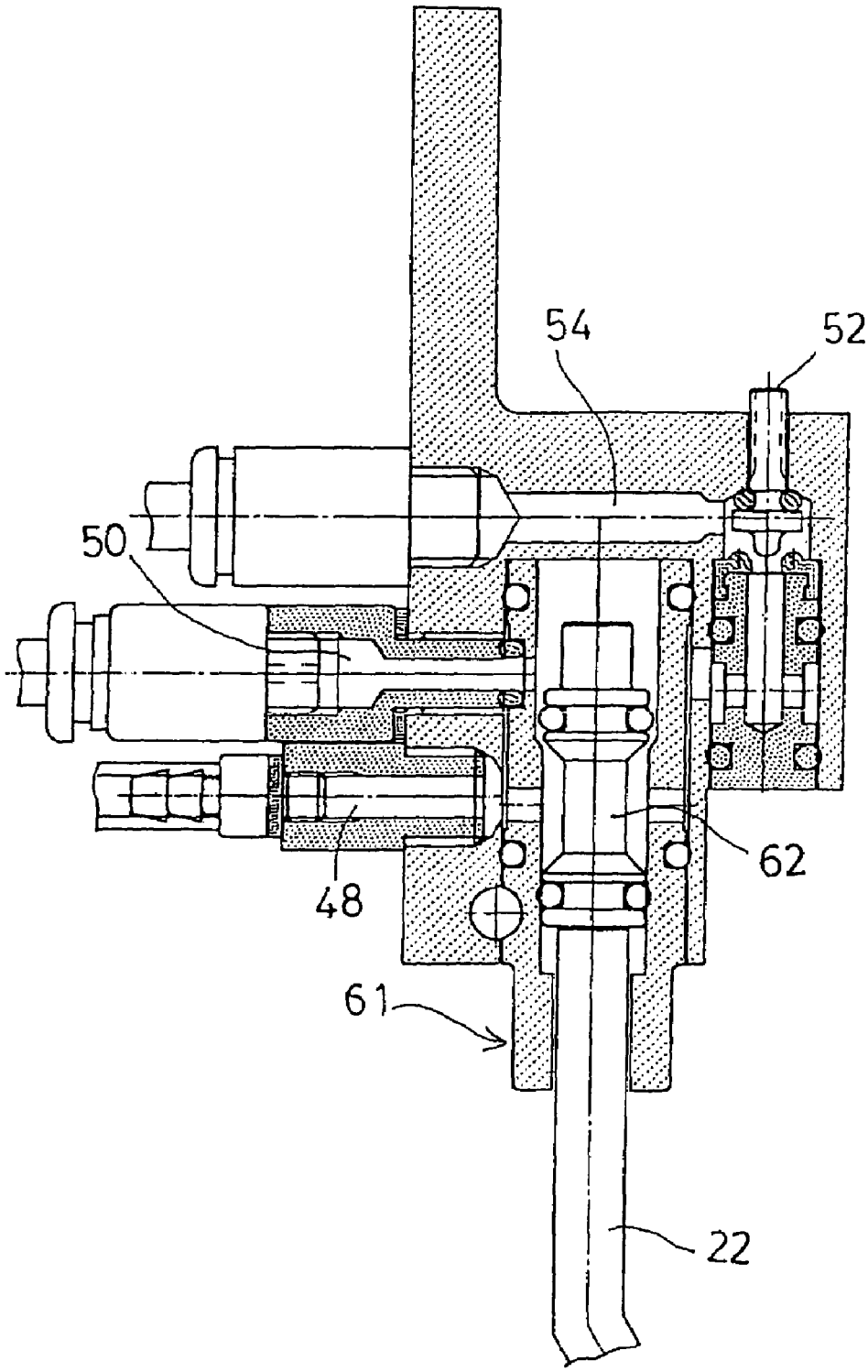

Meanwhile, an explanation will be given of operation of a case of a structure in which different from the above-described contact valve 23, when a contact valve is switched off, secondary side pressure air is not exhausted in reference to FIG. 8 through FIG. 10. Here, a spool 62 of a contact valve 61 is not provided with a path as shown by an initial state of FIG. 8 through FIG. 9, when the contact valve 61 is opened, similar to the contact valve 23 of FIG. 6 and FIG. 7, pressurized air is supplied to the air chamber of the piston controlling pilot valve 41 and the air chamber of the air motor controlling pilot valve 39.

Figure 10:
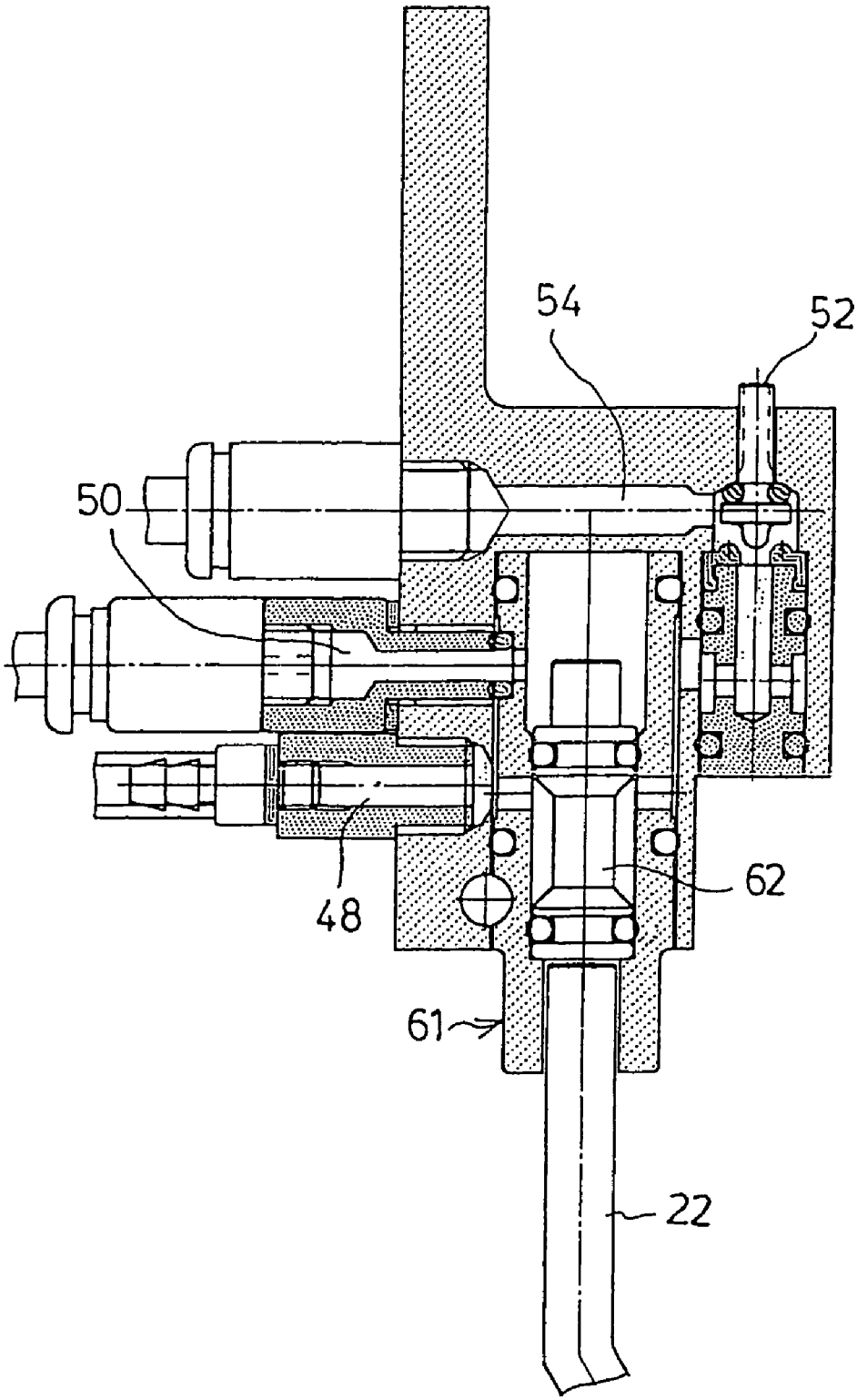
FIG. 10 is a sectional view of a state of returning from the state of making the contact valve of FIG. 8 ON to the initial state.

Further, when pressing of the temporarily pressed contact nose is released to return to the initial position, as shown by FIG. 10, the contact valve 61 is closed and pressurized air supplied to the air chamber of the piston controlling pilot valve 41 and the air chamber of the air motor controlling pilot lever 39 is not discharged. Therefore, when the trigger lever is operated to switch ON under the state, similar to the above-described explanation of the starting operation, the piston controlling pilot valve 41 and the air motor controlling pilot valve 39 and the air motor switching valve 33 are made ON and the air cylinder and the air motor 19 are started to inject a screw, however, according to the invention, as shown by FIG. 6, when the contact valve 23 is disposed at a switch-off position, secondary side pressurized air is exhausted to the atmosphere to thereby resolve a danger of wild running.

Figure 11:
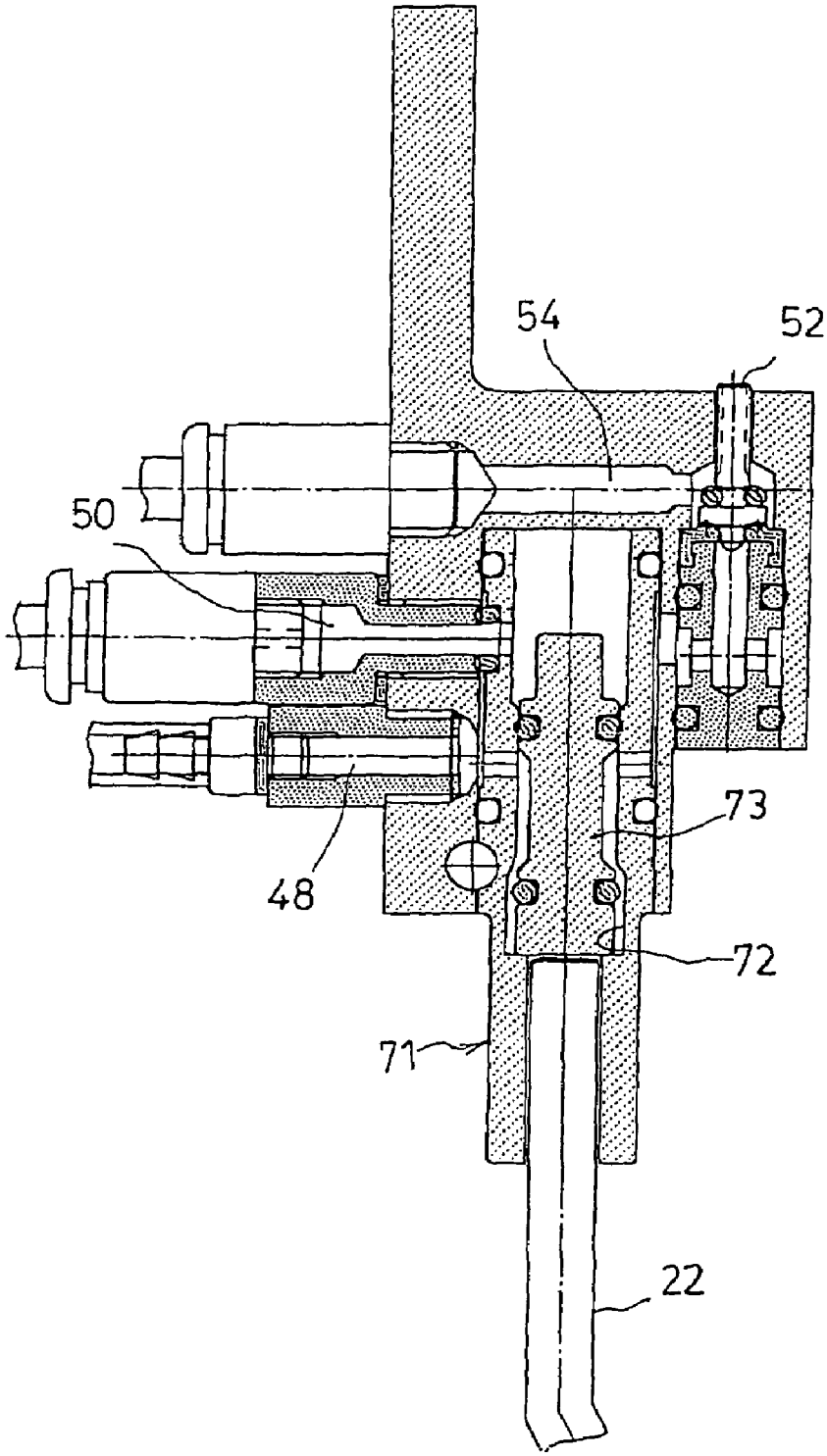
FIG. 11 is a sectional view of an initial state of a contact valve showing other embodiment of the invention.
Figure 12:
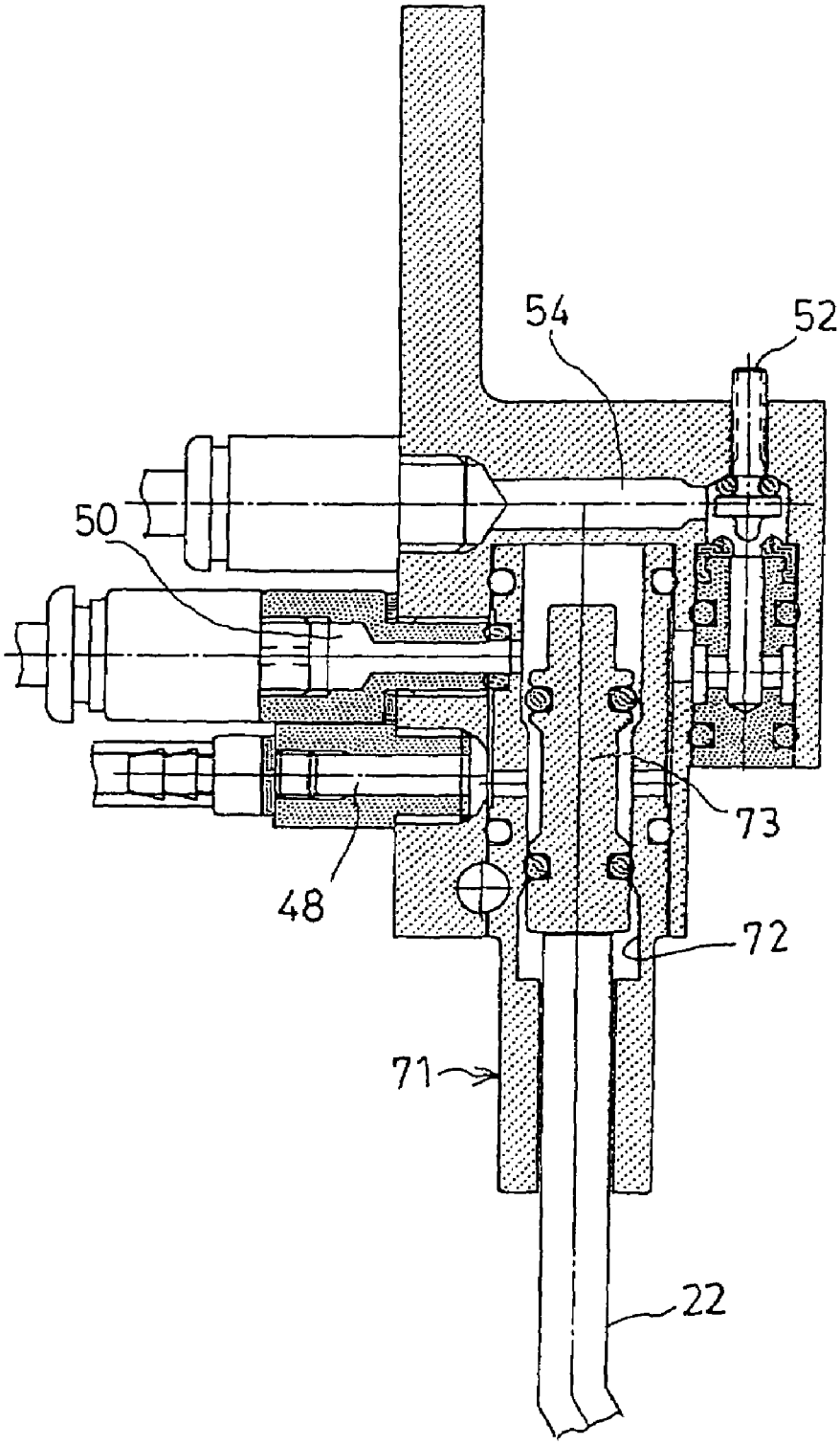

FIG. 11 through FIG. 4 show other embodiment of a contact valve according to the invention, and according to the contact valve 71 shown in FIG. 11, an inner diameter of a lower portion of the cylinder portion 72 is made to be larger than an outer diameter of the spool 73. Therefore, when the spool 73 returns to the initial position, pressurized air remaining at the air chamber of the piston controlling pilot valve 41 and the air chamber of the air motor controlling pilot valve 39 is exhausted to the atmosphere via an exhaust path at a clearance between the lower portion of the cylinder portion 72 and the spool 73. As shown by FIG. 12, when the contact nose is pressed to move up the spool 73, the lower exhaust path of the cylinder portion 72 is cut by the spool 73 and the pressurized air is supplied to the air chamber of the piston controlling pilot valve 41 and the air chamber of the air motor controlling pilot valve 39 to bring about the state of being able to be started by operating the trigger.

Figure 13:
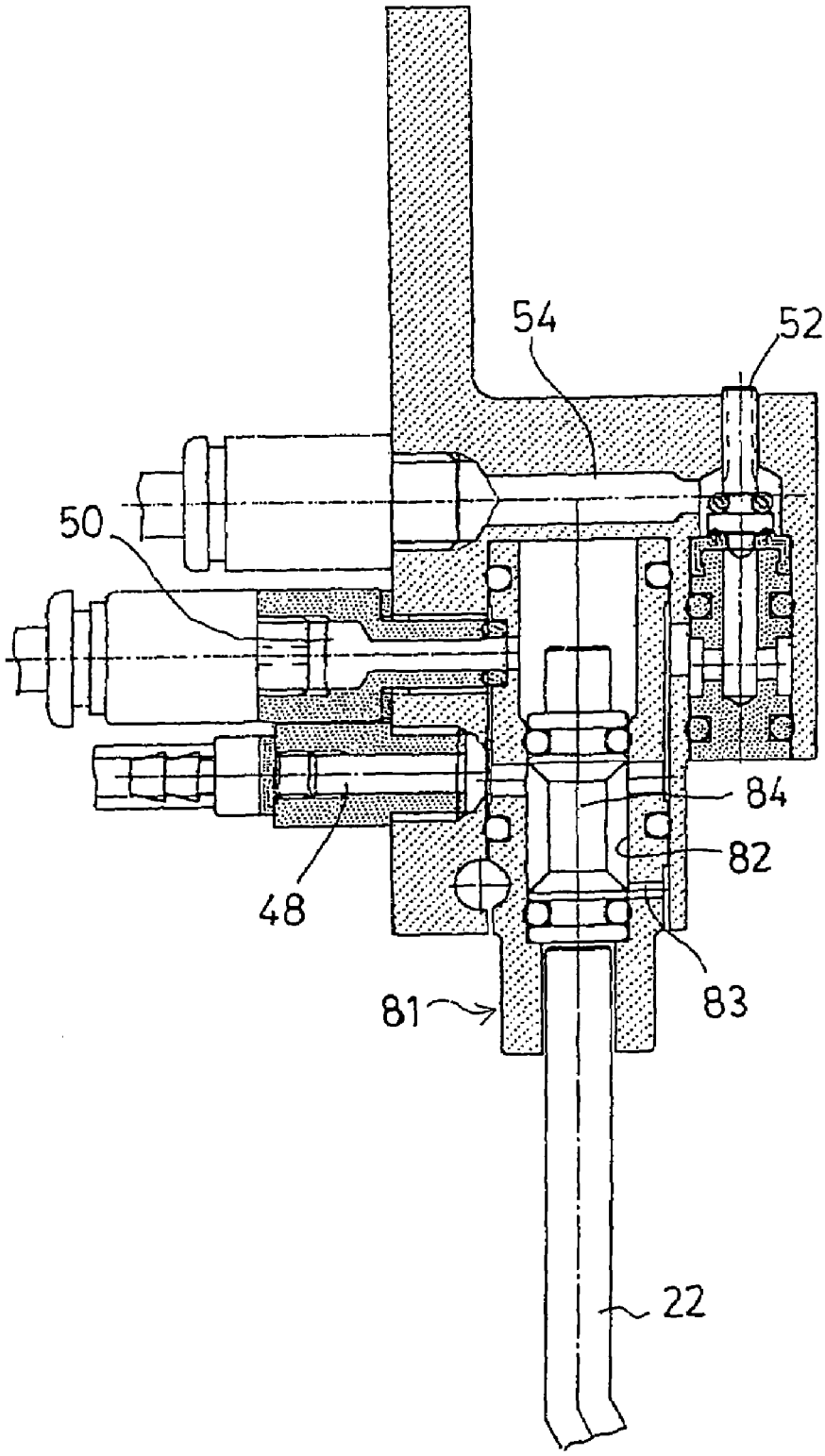
FIG. 13 is a sectional view of an initial state of a contact valve showing other embodiment of the invention.
Figure 14:
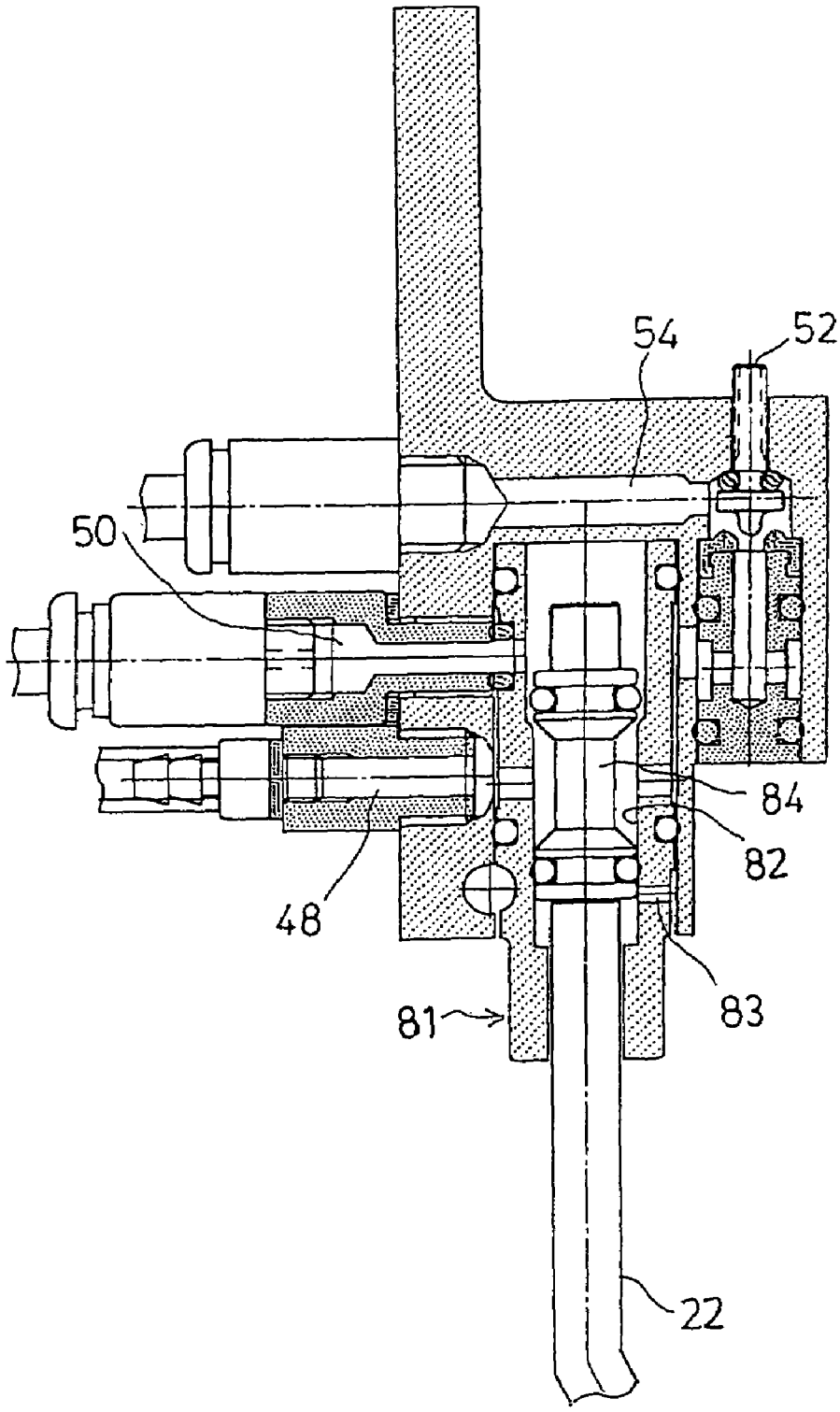

The contact valve 81 shown in FIG. 13 and FIG. 14 is formed with the vent hole 83 at a lower portion of the cylinder portion 82 and as shown by FIG. 13, when the spool returns to the initial position, pressurized air remaining in the air chamber of the piston controlling pilot valve 41 and the air chamber of the air motor controlling pilot valve 39 is exhausted to the atmosphere via the vent hole 83. As shown by FIG. 14, when the contact nose is pressed in the spool 84 is moved upward from the vent hole 83, the vent hole 83 and the lower port 48 and the outlet path 54 are cut, pressurized air is supplied from the upper port 50 to the air chamber of the piston controlling pilot chamber 41 and the air chamber of the air motor controlling pilot valve 39 to bring about a state of being able to be started by operating the trigger. In this way, even in the contact valves 71, 81 shown in FIG. 11 through FIG. 14, safety is achieved when the contact nose is temporality pressed and thereafter returns to the initial position.

Further, the invention is not limited to the above-described embodiments but can variously be modified within the technical range of the invention and the invention naturally covers the modifications.

The application is based on Japanese Patent Application (Japanese Patent Application No. 2001-241323) applied on Aug. 8, 2001 and Japanese Patent Application (Japanese Patent Application No. 2001-241331) applied on Aug. 8, 2001 and contents thereof are incorporated here by reference.

INDUSTRIAL APPLICABILITY

As has been explained above, the safety apparatus of the air impact driver of the invention is constituted to operate the control valve for starting the air impact driver by the trigger valve operated by the trigger lever and the contact valve operated to slide by the contact nose and therefore, the long contact arm reaching the trigger lever from the nose of the mechanical type safety apparatus of the background art is dispensed with, the width of the air impact driver can be narrowed to be able to deal with a corner portion or a location having a narrow width at which operation has been difficult in the background art.

Further, different from moving an intermediary member of the arm, the lever or the like by the contact nose, the contact nose is constituted to operate the valve and therefore, the stroke of the contact nose is extremely shortened and operability and operational efficiency are promoted.

Further, by arranging the contact nose and the contact valve to be proximate to each other, various effects are achieved such that the guide for guiding a member for connecting the contact nose and the contact valve is dispensed with and a concern of bringing about a failure in sliding by clogging a plaster powder or the like at the guide portion is resolved.

The invention claimed is:

1. A safety apparatus of an air impact driver comprising:

a contact nose slidable relative to a nose;

a contact valve connected to the contact nose;

a trigger valve operated by a trigger lever;

a starting control valve; and an air pressure logic circuit for controlling the starting control valve using the trigger valve and the contact valve;

wherein said safety apparatus is provided with a pneumatic signal to start the air impact driver when the trigger valve and the contact valve are switched to ON positions by pressing the contact nose and pulling the trigger lever.

2. The safety apparatus of an air impact driver according to claim 1, wherein the contact valve is switched by sliding the contact nose.

3. The safety apparatus of an air impact driver according to claim 1, wherein the contact valve is a switch valve communicating a secondary side outlet to a primary side inlet when the contact valve is disposed at an ON position and communicating the secondary side outlet to an atmosphere when the contact valve is disposed at an OFF position.

* * * * *